US009985383B2

(12) United States Patent
Williams

(10) Patent No.: US 9,985,383 B2
(45) Date of Patent: May 29, 2018

(54) ELECTRICAL CONNECTOR

(71) Applicant: Connec Limited, Rushcutters Bay, New South Wales (AU)

(72) Inventor: Stephen Williams, Rushcutters Bay (AU)

(73) Assignee: Connec Limited, Rushcutters Bay, New South Wales ( * ) Notice: Subject to any disclaimer, the term of this patent is extended or adjusted under 35 U.S.C. 154(b) by 0 days. days.

(21) Appl. No.: 15/320,735

(22) PCT Filed: Nov. 27, 2014

(86) PCT No.: PCT/AU2014/001082
§ 371 (c)(1),
(2) Date: Dec. 20, 2016

(87) PCT Pub. No.: WO2016/011476
PCT Pub. Date: Jan. 28, 2016

(65) Prior Publication Data

US 2017/0133788 A1 May 11, 2017

(30) Foreign Application Priority Data

Jul. 24, 2014 (AU) ..... 2014902877

(51) Int. Cl.
*H01R 13/58* (2006.01)
*H01R 43/26* (2006.01)

(52) U.S. Cl.
CPC ..... *H01R 13/5804* (2013.01); *H01R 43/26* (2013.01)

(58) Field of Classification Search
CPC ..... H01R 13/5804
See application file for complete search history.

(56) References Cited

U.S. PATENT DOCUMENTS 2,547,394 A * 4/1951 Hynes ..... F16L 19/08 285/341
3,796,504 A 3/1974 Marechal
(Continued)

FOREIGN PATENT DOCUMENTS

EP 2 302 743 A1 3/2011

OTHER PUBLICATIONS

International Search Report dated Dec. 24, 2014 in International Application PCT/AU2014/001082 filed Nov. 27, 2014.
(Continued)

*Primary Examiner* — Ross Gushi
(74) *Attorney, Agent, or Firm* — Knobbe, Martens, Olson & Bear, LLP

(57) ABSTRACT

An electrical connection component for a machine cable is described. The electrical connection component is suitable for transmission of power with voltage levels greater than or equal to 1 k V and comprises a first electrical contact arranged for electrically coupling with a second contact and arranged for direct or indirect coupling to a conductor of the machine cable. The electrical connection component also comprises a housing in which at least a portion of the first electrical contact is positioned, a flexible element for engaging with an outer surface portion of the machine cable, and a cable clamping assembly arranged to couple with a portion of the housing and to clamp the flexible element such that the clamped flexible element secures the machine cable relative to the housing.

18 Claims, 7 Drawing Sheets

(56) References Cited

U.S. PATENT DOCUMENTS

| | | | | |
|---|---|---|---|---|
| 3,861,778 | A | 1/1975 | Capra | |
| 4,142,770 | A | 3/1979 | Butler, Jr. et al. | |
| 5,801,465 | A * | 9/1998 | Yamada ..... | H01R 13/523 174/77 R |
| 6,394,464 | B1 | 5/2002 | Moreau | |
| 7,485,806 | B1 | 2/2009 | Gretz | |
| 2011/0070766 | A1 | 3/2011 | Lindkamp et al. | |

OTHER PUBLICATIONS

Extended European Search Report dated May 26, 2017 for corresponding European Application No. 14897999.0 filed on Nov. 27, 2014.

* cited by examiner

ELECTRICAL CONNECTOR

FIELD OF THE INVENTION

The present invention relates to an electrical connector used in high power applications. In particular the present invention relates to a connector suitable for using in demanding environments such as the petroleum or mining industry.

BACKGROUND OF THE INVENTION

Reliable electrical connections are crucial in high power applications, such as powering of heavy electrical machinery often used in the mining or petroleum industry, or connection of power transportation lines. In these applications machine cables transmit high currents at voltages of one or more kilovolts.

Typical electrical connectors used in the art have a plurality of pins or sockets each connected to a respective core of the machine cable. Depending on the specific application, the connectors must comply with specific requirements or standards. The compliance of the connectors with the relevant standards is examined by a certifying body.

The certification of a connector for a specific application does generally ensure that the connector meets basic safety requirements. However, known connectors still have a number of disadvantages.

For example, high power connectors used in demanding environments such as mining sites, are often subject to harsh treatment, especially when connected to heavy machinery. Machine cables may be inadvertently pulled during operation and this may lead to damage of internal components of the connector or the machine cable at the connector and/or loss of electrical connection with obvious implications for the operation safety.

SUMMARY OF THE INVENTION

Embodiments of the present invention aim to provide an electrical connection component that is arranged such that the possible transmission of stresses to cores of the machine cable is reduced when the electrical connection component is in operation.

In accordance with the first aspect, the present invention provides an electrical connection component for a machine cable, the electrical connection component being suitable for transmission of power with voltage levels greater than or equal to 1 kV, the electrical connection component comprising:

- a first electrical contact arranged for electrically coupling with a second contact and arranged for direct or indirect coupling to a conductor of the machine cable
- a housing in which at least a portion of the first electrical contact is positioned;
- a flexible element for engaging with an outer surface portion of the machine cable; and
- a cable clamping assembly arranged to couple with a portion of the housing and to clamp the flexible element such that the clamped flexible element secures the machine cable relative to the housing.

In an embodiment, the cable clamping assembly and the flexible element are arranged such that in use a clamping force is exerted by the flexible element to the portion of the machine cable and the clamping force is distributed substantially uniformly around the portion of the machine cable.

In an embodiment, the cable clamping assembly partially surrounds the flexible element. The flexible element may comprise a resilient annular member that is arranged to receive the machine cable. The resilient annular member may have cylindrical shape and may be axially uniform. Further, an outer surface of the resilient annular member may be tapered. The tapered outer surface may be arranged such that in use it is in contact with a respective tapered surface of the clamping assembly.

In an embodiment, the annular member is a ring-like member that comprises a polymeric material, which may be a high strength polymeric material.

In an embodiment, the cable clamping assembly may comprise:

- a first cable collar element for disposing around the machine cable, the first collar element being adapted to press the flexible element, when positioned around an outer surface portion of the machine cable and between the collar element and the housing portion, towards the housing portion in a manner such that the flexible element deforms and imparts a clamping force around the outer surface portion of the machine cable.

In an embodiment, the first collar element has an inner surface that is tapered and is arranged such that in use the tapered inner surface is in contact with a respective tapered outer surface of the flexible element. In use the flexible element may be wedged between the clamping assembly and the machine cable, between the clamping assembly and a portion of the housing, or between a first portion of the clamping assembly and a second portion of the clamping assembly.

In an embodiment, the first collar element is a ring-like bracket which comprises a plurality of bores adapted to receive a plurality of fasteners for securing to the housing portion.

In an embodiment, the cable clamping assembly may further comprise a second collar element that in use is disposed around the machine cable, the first and second collar elements being adapted to press the flexible element, when positioned around an outer surface portion of the machine cable and between the first and second collar elements, towards the housing portion in a manner such that the flexible element deforms and imparts a clamping force around the outer surface portion of the machine cable.

In an embodiment, the first or the second collar element has an inner surface that is tapered and is arranged such that in use the tapered inner surface is in contact with a respective tapered outer surface of the flexible element. In use the flexible element may be wedged between the first collar element and the second collar element.

Further, in use the first and the second collar elements may be securely fastened to the housing portion of the component by a plurality of fasteners engaging the first and the second collar elements at a plurality of locations disposed around the machine cable. The plurality of fasteners may be in the form of a plurality of bolts or screws positioned in a plurality of bores substantially evenly distributed around the machine cable.

In an embodiment, the machine cable is coupled in use to the housing via the flexible element such that the flexible element transfers external longitudinal forces on the machine cable to the housing and not the first contact.

In one embodiment the electrical connection component comprises a plurality of electrically insulating components that are arranged such that they fit within the housing in a predefined orientation or set of orientations. For example, a first electrically insulating component may be shaped so as to fit with a second electrically insulating component in a predefined orientation. For example, the first electrically insulating component may have a protrusion having a particular shape, with the second insulating component having a correspondingly shaped recess for receiving the protrusion of the first electrically shaped recess wherein, when the first insulating component is received in the second insulating component, the first and second insulating components have a predefined orientation with respect to one another.

Further, an electrically insulating component may be arranged so as to receive a plurality of other electrically insulating components, wherein at least one of the electrically insulating components surrounds at least a portion of the at least one conductor, an electrical conductor of the electrical connection component penetrating therethrough.

One of the electrically insulating components may be removable, the housing and the removable component being arranged such that at least a portion of an internal region of the housing can be inspected when the removable component has been at least partially removed from the housing.

In accordance with a second aspect, the present invention provides a method of connecting an electrical connection component in accordance with the first aspect to a machine cable suitable for transmission of power with voltage levels greater than or equal to 1 kV, the method comprising the steps of:

providing the machine cable;

positioning a flexible element of the connection component around the machine cable;

positioning a cable collar element of the connection component around the machine cable such that the flexible element is positioned between the cable collar element and a housing portion of the connection component; and mounting the cable collar element to the housing portion in a manner such that the flexible element is positioned between the housing portion of the connection component and the cable collar element and a clamping force is imparted via the flexible portion and around an outer surface portion of the machine cable to secure the machine cable relative to the housing portion.

In an embodiment, the cable collar element is mounted to the housing in manner such that the flexible element transfers external longitudinal forces on the machine cable to the housing and not the first contact.

In an embodiment, the cable collar element is mounted to the housing in manner such that the flexible element exerts a clamping force to the portion of the machine cable and the clamping force is distributed substantially uniformly around the portion of the machine cable.

In an embodiment, the flexible element comprises a resilient annular member that is arranged to receive the machine cable. The annular member may be a ring-like member, the cable collar element may comprise a ring-like bracket and the method may further comprise the step of fastening a plurality of fasteners through the ring-like bracket to the housing for securing the cable collar element and the annular member to the housing.

In accordance with a third aspect, the present invention provides a method of connecting an electrical connection component in accordance with the first aspect of the present invention to a machine cable suitable for transmission of power with voltage levels greater than or equal to 1 kV, the method comprising the steps of:

providing a machine cable;

positioning a flexible element around the machine cable;

positioning first and second cable collar elements around the machine cable and relative to a housing portion of the connection component such that the flexible element is positioned between the first and second cable collar elements; and mounting the first and second cable collar elements to the housing portion in a manner such that the flexible element is positioned between the first and second collar elements and a clamping force is imparted via the flexible portion and around an outer surface portion of the machine cable to secure the machine cable relative to the housing portion.

In an embodiment, the first and second cable collar elements are mounted to the housing in manner such that the flexible element transfers external longitudinal forces on the machine cable to the housing and not the first contact.

In an embodiment, the first and second cable collar elements are mounted to the housing in manner such that the flexible element exerts a clamping force to the portion of the machine cable and the clamping force is distributed substantially uniformly around the portion of the machine cable.

In an embodiment, the flexible element comprises a resilient annular member that is arranged to receive the machine cable. The annular member may be a ring-like member, each of the first and the second cable collar elements may comprise respectively a first and a second ring-like bracket and the method may further comprise the step of fastening a plurality of fasteners through the first and the second ring-like brackets to the housing for securing the cable collar element and the annular member to the housing.

The invention will be more fully understood from the following description of specific embodiments of the invention. The description is provided with reference to the accompanying drawings.

DETAILED DESCRIPTION OF SPECIFIC EMBODIMENTS

Embodiments described herein provide an electrical connection component suitable for high power applications for connecting a machine cable. The connection component has a flexible element and a clamping assembly which engages the outer surface of the machine cable and secures the machine cable to the housing of the electrical connection component.

Figure 1:
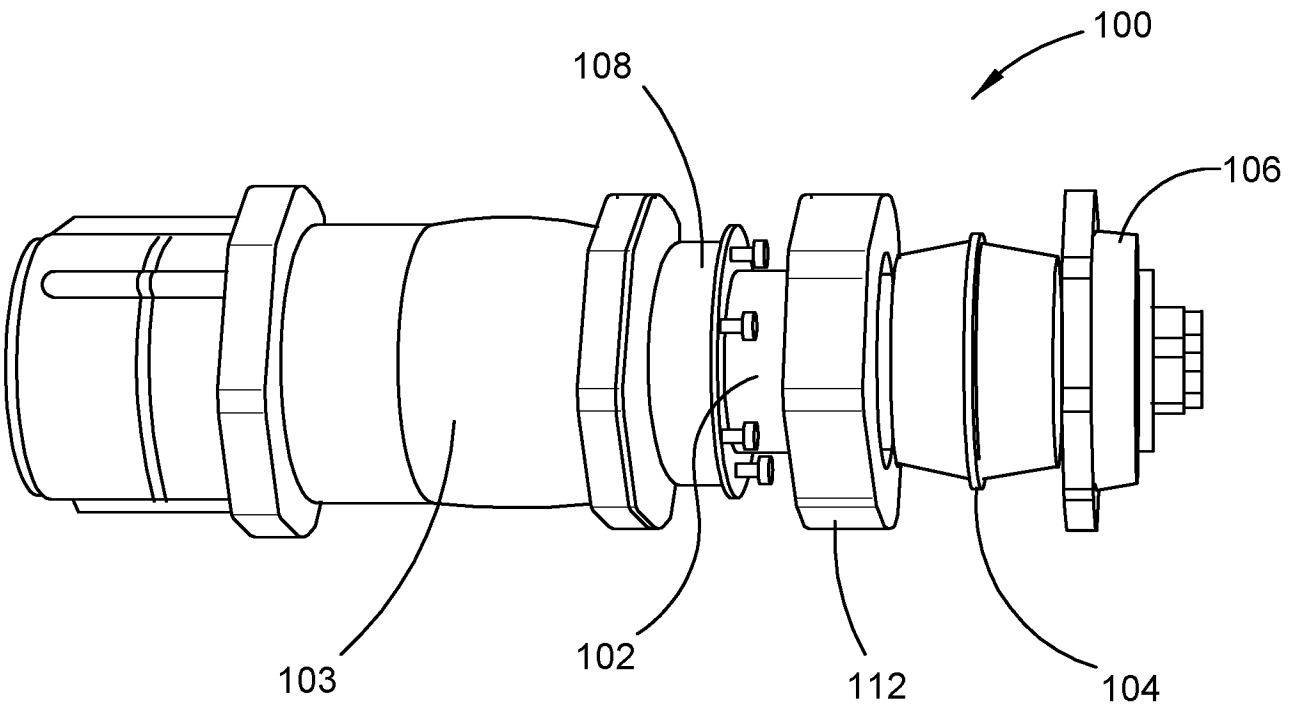
FIG. 1 is a side view of a connector component in accordance with an embodiment while being assembled.
Figure 2B:
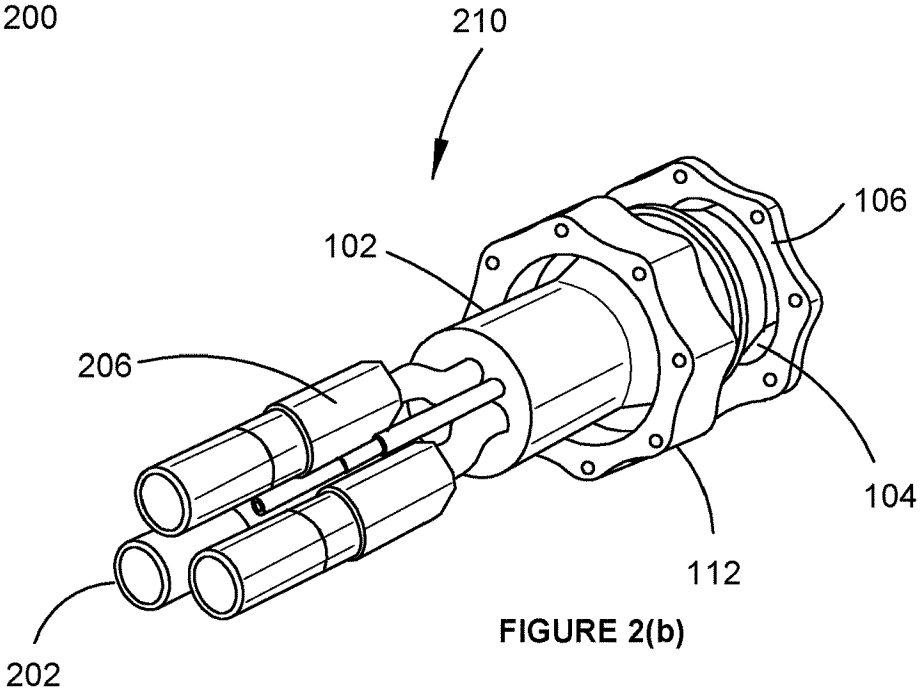
FIG. 2 shows isometric views of a machine cable fitted with components of the connection component of the embodiment.
Figure 2A:
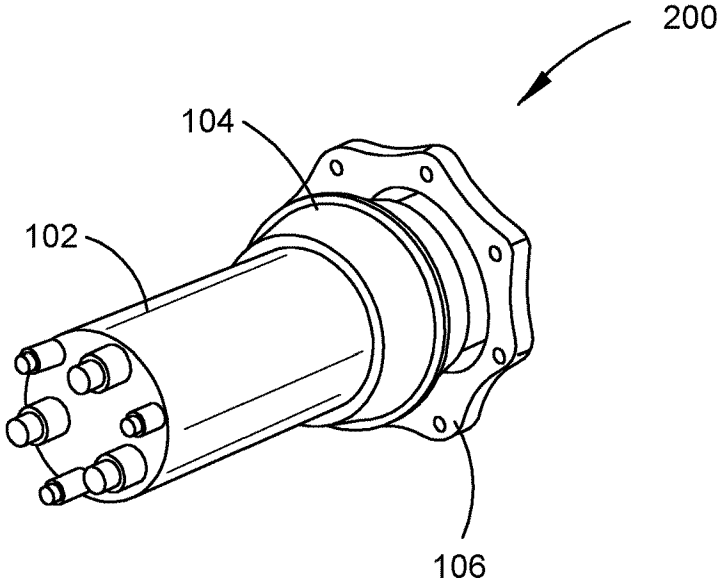

Referring initially to FIGS. 1 to 5, there is shown an electrical connection component 100 for a machine cable 102, which is suitable for transmission of power with voltage levels greater than or equal to 1 kV. The electrical connection component has a housing 103 that contains electrical pins or sockets (not shown) that are electrically connected to cores of the machine cable 102. The electrical pins or sockets are arranged to be connected to respective pins or sockets of another connection component to create electrical connections between cores of two machine cables. In this embodiment, the electrical connection component has six electrical pins, one for each electrical phase, contained in three phase tubes 202, and three electrical pins for connecting to pilot and auxiliary power circuits, as shown in FIG. 2(*b*). Each electrical phase pin has an independent earth connection through its respective phase tube 206.

The electrical connection component 100 has a flexible element, in the form of a resilient ring-like member 104, which receives the machine cable 102 and engages a portion of its outer surface. A clamping force is exerted by the flexible element to the portion of the machine cable 102 and the clamping force is distributed substantially uniformly around the portion of the machine cable 102.

In this embodiment, the resilient ring-like member 104 is composed of a polymeric material and is disposed within a cable clamping assembly that has two cable collar elements, one disposed at a cable side of the ring-like member 104 and one disposed at the housing side. The two cable collar elements are provided in the form of ring-like brackets 106 and 112. FIG. 2 shows how the ring-like brackets 106 and 112 can be fitted around the machine cable together with the ring-like member 104 before or after the electrical pins, the phase tubes 202 and the housing 103 are connected to the machine cable 102.

When the ring-like brackets 106 and 112 are fastened together, they press the ring-like member 104 from opposite sides in a manner such that the ring-like member 104 deforms and imparts a clamping force around the machine cable 102. The clamping force secures the clamping assembly with the ring-like brackets 106 and 112 and the ring-like member 104 to the machine cable 102.

In the embodiment described the ring-like member 104 has a 'donut-like' shape. The shape of the ring-like member 104 allows the member 104 to be wedged in use between the clamping assembly with ring-like brackets 106 and 112. In alternative embodiments, the ring-like member 104 may be uniform along its axis or have a tapered outer surface. It will be appreciated that, for alternative sizes, a spacer may be provided between the ring-like member 104 and the ring-like brackets 106, 112.

Figure 3:
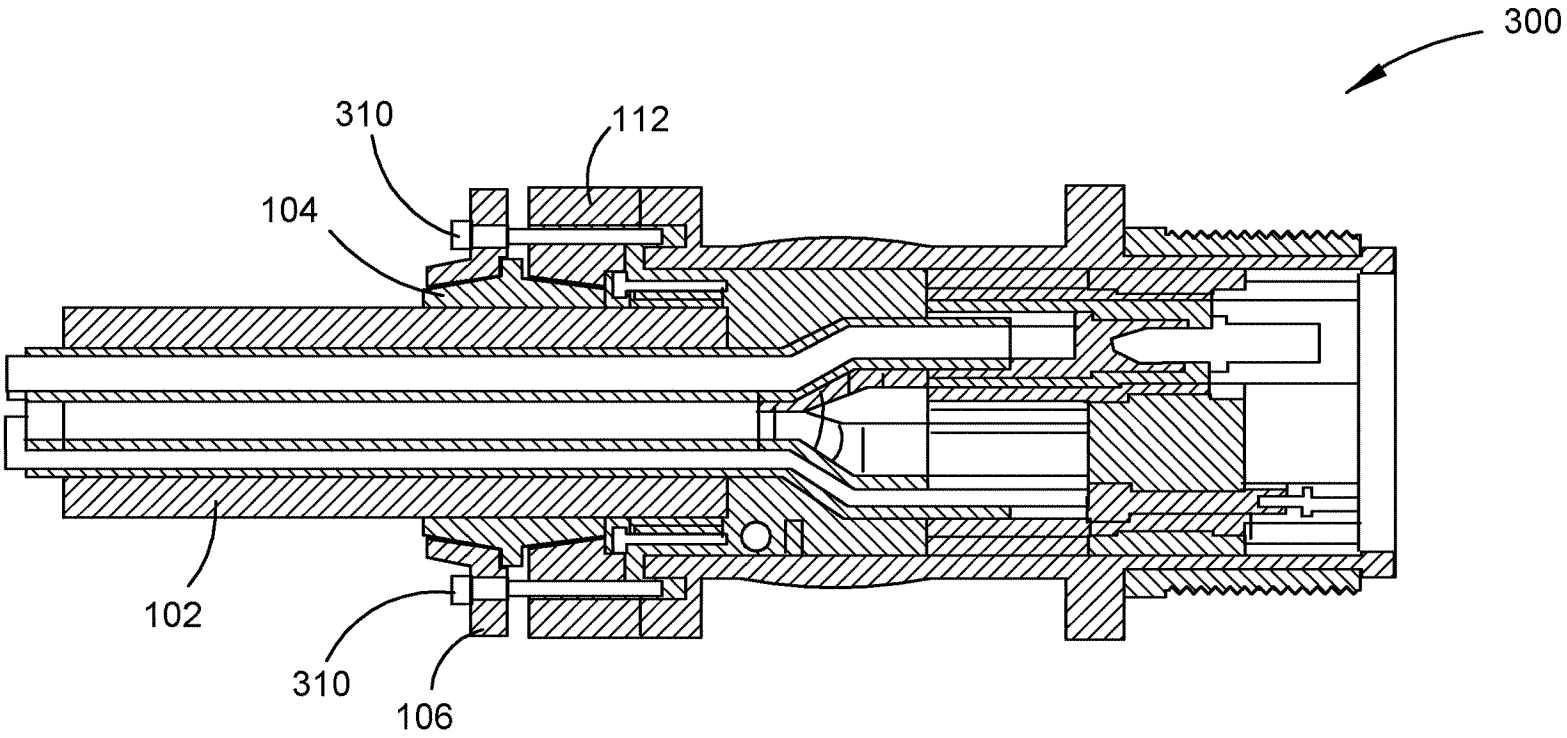
FIG. 3 is a side cross-sectional view of an assembled connector according to the embodiment.
Figure 4:
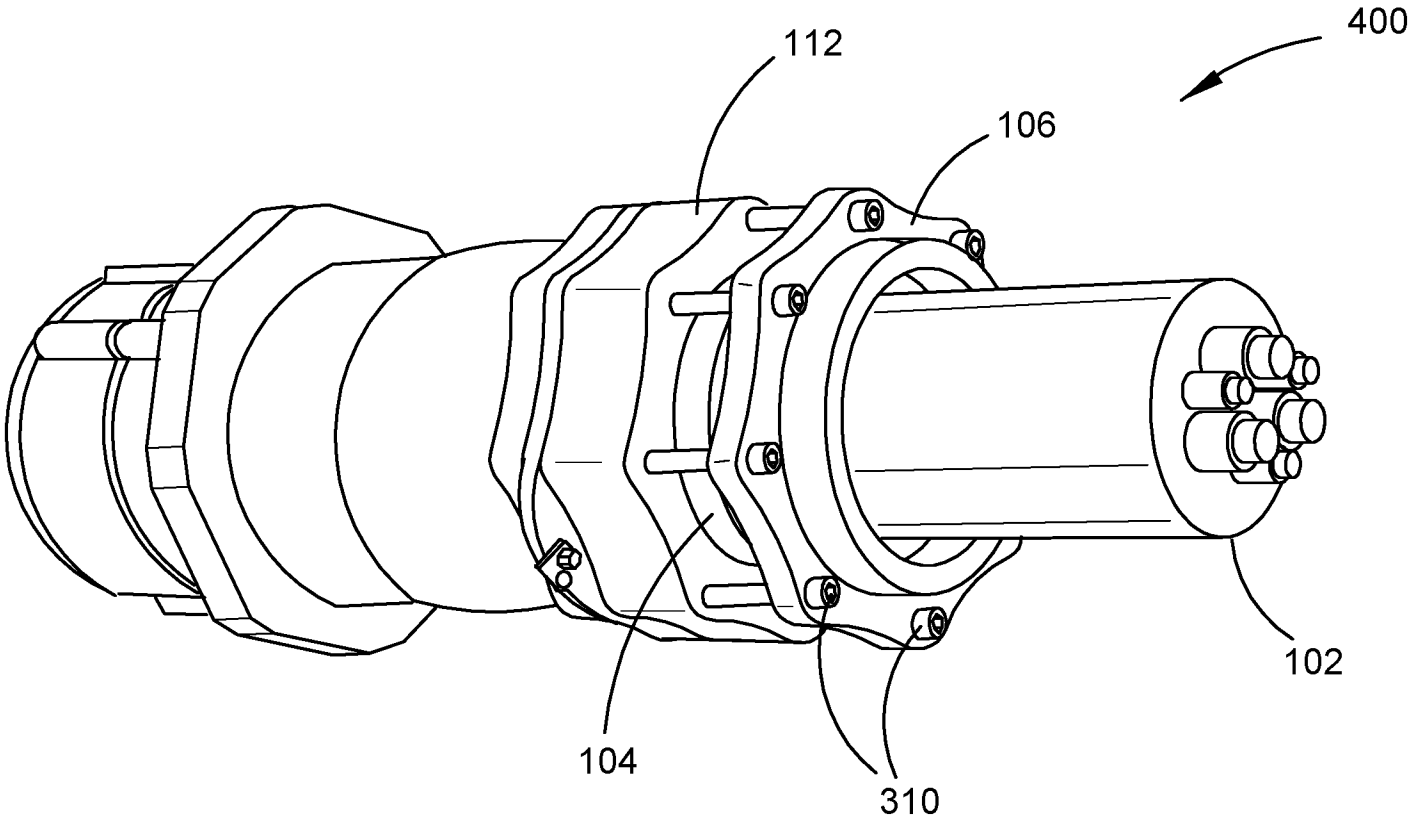
FIG. 4 is an isometric view of an assembled connector according to the embodiment.
Figure 5:
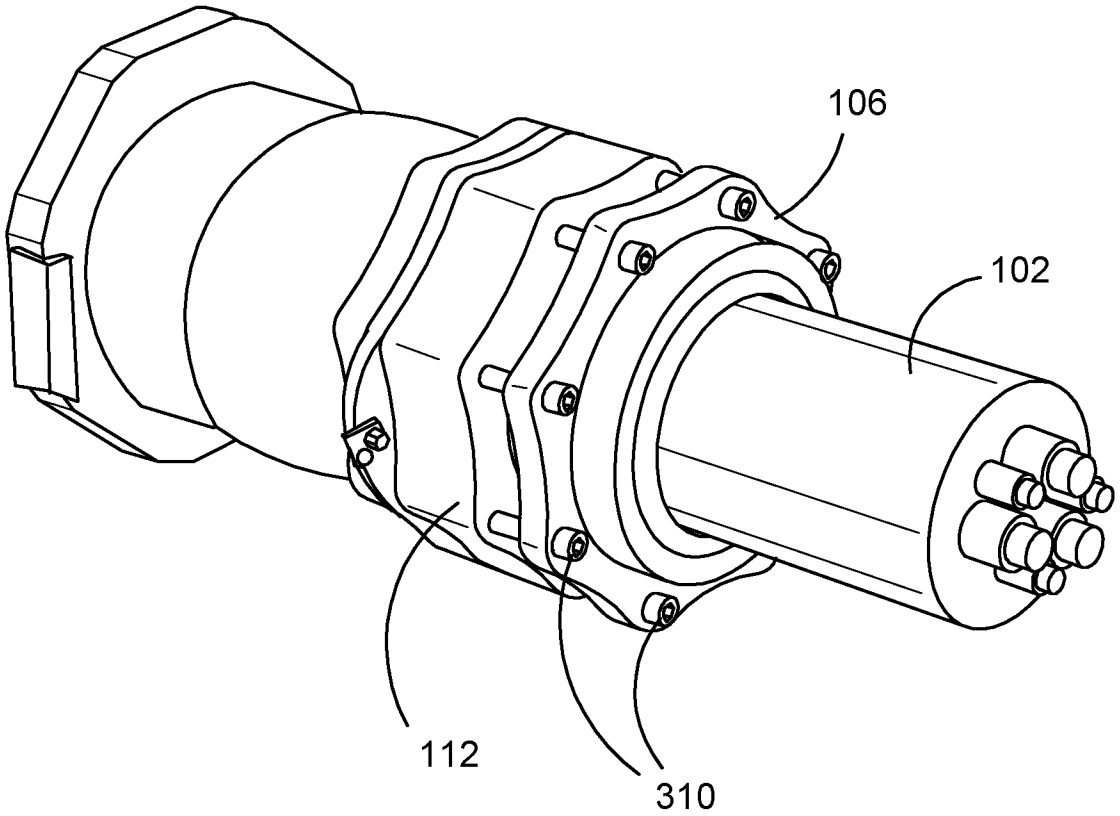
FIG. 5 is an isometric view of the connector according to the embodiment when inserted into the corresponding receptacle plug.

The ring-like member 104 comprises a polymeric material. FIGS. 3 and 4 respectively show a side cross-sectional view and an isometric view of the assembled electrical connector of the embodiment. When the connection component is assembled the ring-like brackets 106 and 112 are fastened together and also securely fastened to the housing of the component using a plurality of fasteners engaging the ring-like brackets 106 and 112 at a plurality of locations disposed around the machine cable 102. In this embodiment, the fasteners are in the form of bolts 310 positioned in a plurality of bores evenly distributed around the periphery of the ring-like brackets 106 and 112. The bolts 310 engage threaded bore portion located on the portion of the housing 103 facing ring-like bracket 112 in correspondence of the plurality of bores.

The engagement of the ring-like brackets 106 and 112 with the ring-like member 104 and the housing 103 enables the transmission of axial loads from the machine cable 102 to the housing 103. The load bearing function provided by ring-like brackets 106 and 112, ring-like member 104 and the housing 103 prevents axial loads to be transferred to the internal connections between the pins or sockets and the cores of the machine cable.

In alternative embodiments the ring-like bracket 112 is provided as an integral part of the housing 103. In these embodiments the connection component is provided with one ring-like bracket 106. The ring-like bracket 106 presses onto the ring-like member 104 from the machine cable 102 side when the ring-like bracket 106 is fastened to the housing 103. The ring-like member 104 deforms and imparts a clamping force around the machine cable 102 to secure the clamping assembly and the housing to the machine cable 102. This allows transferring external longitudinal forces on the machine cable 102 to the housing and not the first contact.

Damage to the connections between pins or sockets to cable cores due to applied external axial loads, is a common source of electrical faults when the cables are used in challenging environments, such as petrochemical sites or mining sites. As the connection device transmits such axial loads at least largely to the housing, the likelihood of such damage can be reduced. Further, the connection component is arranged such that the applied external axial force is transmitted to the housing by the flexible element in a manner such that, because of the flexibility of the flexible portion that engages with the outer surface portion of the machine cable within a relatively large area, local radial pressures on the outer surface portion of the machine cable are reduced.

In one embodiment the electrical connection component 100 comprises a plurality of electrically insulating components that are arranged such that they fit within the housing 103 in a predefined orientation or set of orientations. For example, a first electrically insulating component may be shaped so as to fit with a second electrically insulating component in a predefined orientation. For example, the first electrically insulating component may have a protrusion having a particular shape, with the second insulating component having a correspondingly shaped recess for receiving the protrusion of the first electrically shaped recess wherein, when the first insulating component is received in the second insulating component, the first and second insulating components have a predefined orientation with respect to one another.

Further, an electrically insulating component may be arranged so as to receive a plurality of other electrically insulating components, wherein at least one of the electrically insulating components surrounds at least a portion of the at least one conductor, an electrical conductor of the electrical connection component penetrating therethrough.

One of the electrically insulating components may be removable, the housing 103 and the removable component being arranged such that at least a portion of an internal region of the housing 103 can be inspected when the removable component has been at least partially removed from the housing 103.

Figure 6:
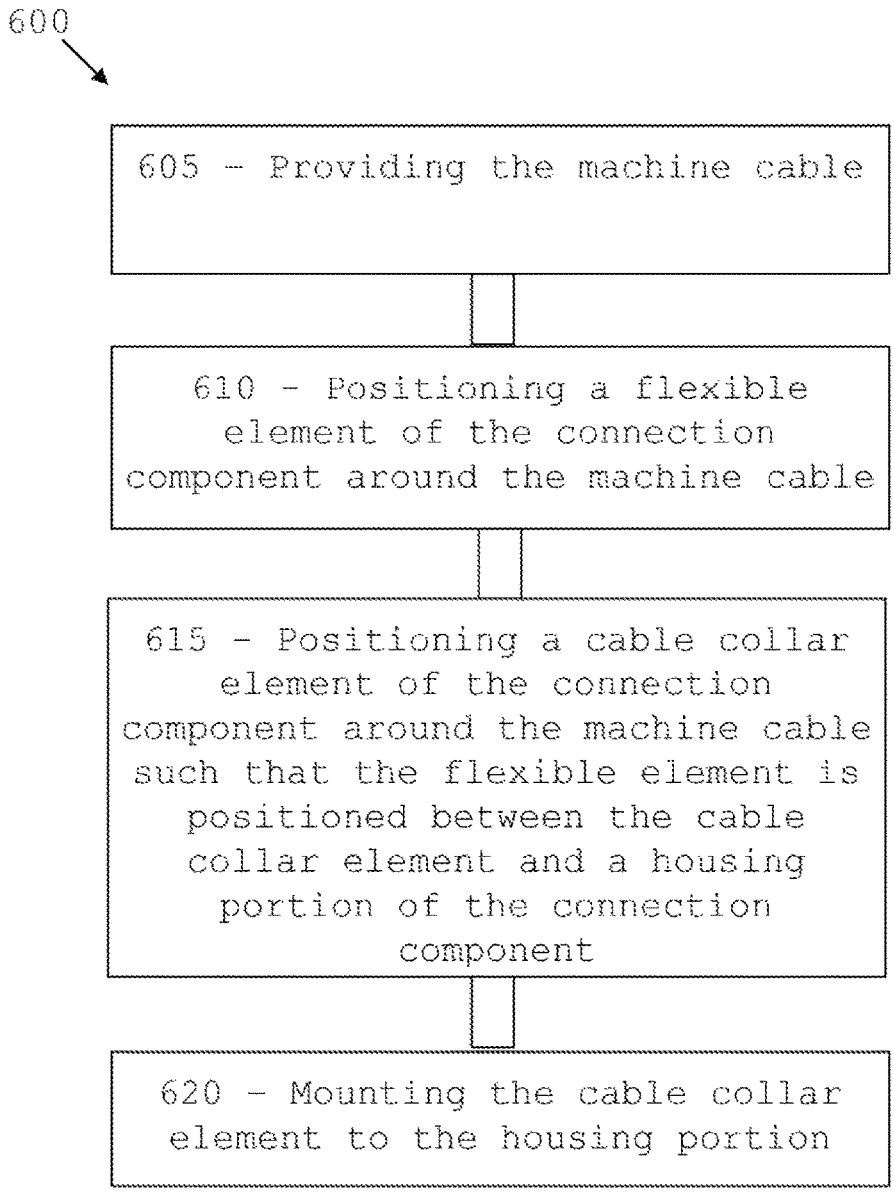
FIG. 6 is a flow-chart showing steps to connect an electrical connection in accordance with an embodiment to a machine cable.

Referring now to FIG. 6 there is shown a flow-chart with a sequence of steps which may be performed to connect an electrical connection component in accordance with an embodiment to a machine cable. Once the machine cable is provided, 605, the flexible element is positioned around the machine cable, 610. In the embodiment described above this step consists in inserting the machine cable 102 in the ring-like member 104. At step 615 the cable collar element is positioned around the machine cable such that the flexible element is positioned between the cable collar element and a housing portion of the connection component. In the embodiment, the ring-like bracket 106 is positioned around the machine cable 102. At step 620 the cable collar element is mounted to the housing portion so that the flexible element is positioned between the housing portion of the connection component and the cable collar element and a clamping force is imparted via the flexible portion and around an outer surface portion of the machine cable to secure the machine cable relative to the housing portion. In the embodiment described, the bolts 310 are inserted in the peripheral bores of the ring-like bracket 106 and engaged with respective threaded bores in the component housing 103.

In alternative embodiments, the method comprises the further step of mounting a further ring-like bracket 112 to the housing 103 before aligning and securing the clamping assembly to the housing 103.

Figure 7:
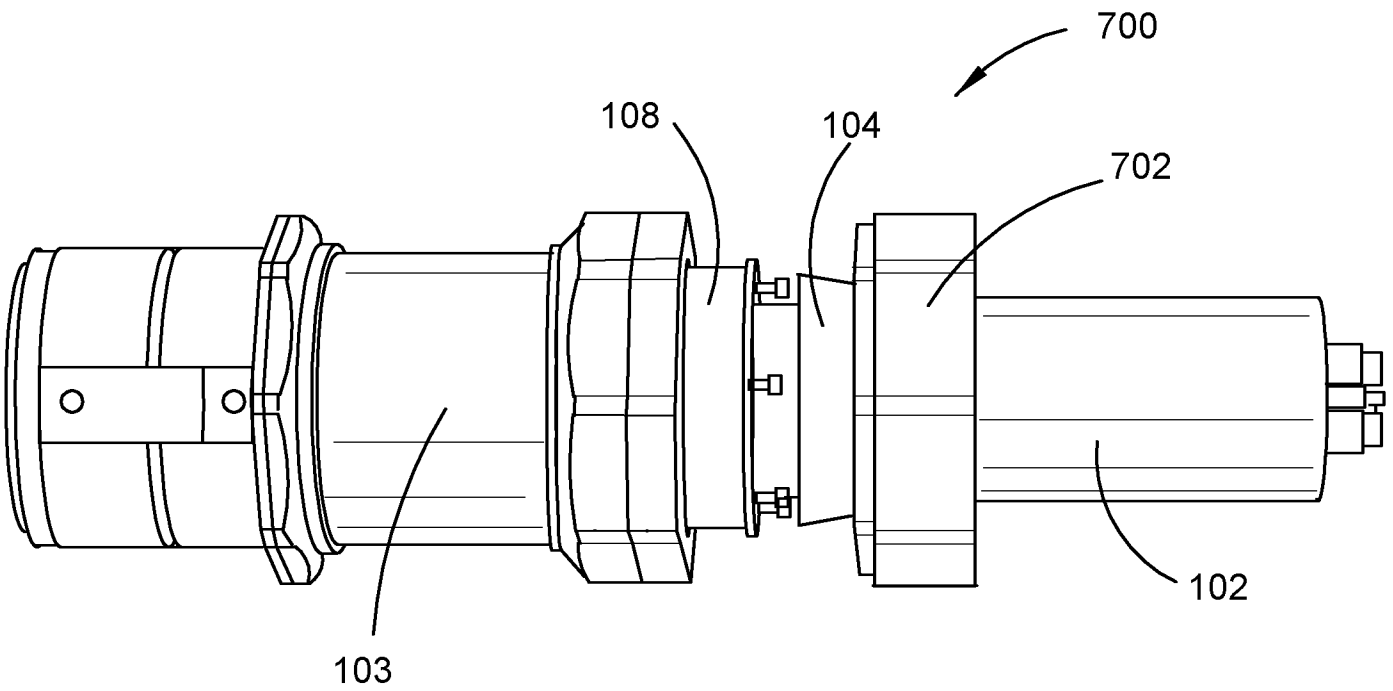
FIG. 7 is a side view of a connector component in accordance with an alternative embodiment of the present invention.

An alternative electrical connection component 700 is shown in FIG. 7. The electrical connection component 700 comprises many of the same features as the electrical connection component 100 of FIG. 1, however the two ring-like brackets 106 and 112 of the electrical connection component 100 have been incorporated into a single ring-like bracket 702.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. An electrical connection component for a machine cable, the electrical connection component being suitable for transmission of power with voltage levels greater than or equal to 1 kV, the electrical connection component comprising:

a first electrical contact arranged for electrically coupling with a second contact and arranged for direct or indirect coupling to a conductor of the machine cable;

a housing in which at least a portion of the first electrical contact is positioned;

a flexible element for engaging with an outer surface portion of the machine cable; and a cable clamping assembly comprising a first ring-like element for disposing around the machine cable, the first ring-like element comprising a plurality of bores adapted to receive a plurality of fasteners for securing to the housing portion and for pressing the first ring-like element towards the flexible element and the housing portion, when the flexible element is positioned around an outer surface portion of the machine cable and between the first ring-like element and the housing portion, in a manner such that the flexible element deforms and imparts a clamping force around the outer surface portion of the machine cable, wherein the cable clamping assembly further comprises a second ring-like element that in use is disposed around the machine cable, the first and second ring-like elements being adapted to press the flexible element, when positioned around an outer surface portion of the machine cable and between the first and second ring-like elements, towards the housing portion in a manner such that the flexible element deforms and imparts a clamping force around the outer surface portion of the machine cable.

2. The component of claim 1 wherein the cable clamping assembly and the flexible element are arranged such that in use a clamping force is exerted by the flexible element to the portion of the machine cable and the clamping force is distributed substantially uniformly around the portion of the machine cable.

3. The component of claim 1 wherein the cable clamping assembly partially surrounds the flexible element.

4. The component of claim 1 wherein the flexible element comprises a resilient annular member that is arranged to receive the machine cable.

5. The component of claim 4 wherein the annular member is a ring-like member that comprises a polymeric material.

6. The component of claim 1 wherein the tapered outer surface of the flexible element is arranged such that in use the tapered outer surface is in contact with a respective tapered surface of the clamping assembly.

7. The component of claim 1 wherein the first ring-like element has an inner surface that is tapered and is arranged such that in use the tapered inner surface is in contact with a respective tapered outer surface of the flexible element.

8. The component of claim 7 wherein in use the flexible element is wedged between the clamping assembly and the machine cable.

9. The component of claim 7 wherein in use the flexible element is wedged between the clamping assembly and a portion of the housing.

10. The component of claim 7 wherein in use the flexible element is wedged between a first portion of the clamping assembly and a second portion of the clamping assembly.

11. The component of claim 1 wherein in use the flexible element is wedged between the first ring-like element and the second ring-like element.

12. The component of claim 1 wherein in use the first and the second ring-like elements are securely fastened to the housing portion of the component by a plurality of fasteners engaging the first and the second ring-like elements at a plurality of locations disposed around the machine cable.

13. The component of claim 1 wherein in use the machine cable is coupled to the housing via the flexible element such that the flexible element transfers external longitudinal forces on the machine cable to the housing and not the first contact.

14. An electrical connection component for a machine cable, the electrical connection component being suitable for transmission of power with voltage levels greater than or equal to 1 kV, the electrical connection component comprising:

a first electrical contact arranged for electrically coupling with a second contact and arranged for direct or indirect coupling to a conductor of the machine cable;

a housing in which at least a portion of the first electrical contact is positioned;

a flexible element for engaging with an outer surface portion of the machine cable, wherein the flexible element comprises a tapered outer surface; and a cable clamping assembly comprising a first ring-like element for disposing around the machine cable, the first ring-like element comprising a plurality of bores adapted to receive a plurality of fasteners for securing to the housing portion and for pressing the first ring-like element towards the flexible element and the housing portion, when the flexible element is positioned around an outer surface portion of the machine cable and between the first ring-like element and the housing portion, in a manner such that the flexible element deforms and imparts a clamping force around the outer surface portion of the machine cable, wherein the cable clamping assembly further comprises a second ring-like element that in use is disposed around the machine cable, the first and second ring-like elements being adapted to press the flexible element, when positioned around an outer surface portion of the machine cable and between the first and second ring-like elements, towards the housing portion in a manner such that the flexible element deforms and imparts a clamping force around the outer surface portion of the machine cable.

15. A method of connecting an electrical connection component to a machine cable suitable for transmission of power with voltage levels greater than or equal to 1 kV, the method comprising the steps of:

providing the machine cable;

positioning a flexible element of the connection component around the machine cable;

positioning a first ring-like element around the machine cable such that the flexible element is positioned between the first ring-like element and a housing portion of the connection component;

mounting the first ring-like element to the housing portion by fastening a plurality of fasteners through respective bores in the first ring-like element in a manner such that the flexible element is positioned between the housing portion of the connection component and the first ring-like element and a clamping force is imparted via the flexible element and around an outer surface portion of the machine cable to secure the machine cable relative to the housing portion; and positioning a second ring-like element around the machine cable such that the flexible element is positioned between the first and the second ring-like elements.

16. The method of claim 15 wherein the first ring-like element is mounted to the housing in manner such that the flexible element transfers external longitudinal forces on the machine cable to the housing and not the first contact.

17. The method of claim 15 wherein the first ring-like element is mounted to the housing in manner such that the flexible element exerts a clamping force to the portion of the machine cable and the clamping force is distributed substantially uniformly around the portion of the machine cable.

18. The method of claim 15 wherein the flexible element comprises a resilient annular member that is arranged to receive the machine cable.

* * * * *